US005782029A

United States Patent [19]

Brooks

[11] Patent Number: 5,782,029

[45] Date of Patent: Jul. 21, 1998

[54] FIREARM SAFETY MECHANISM

[75] Inventor: Frank Brooks, Jupiter, Fla.

[73] Assignee: SAF T LOK Corporation, Tequesta, Fla.

[21] Appl. No.: 719,473

[22] Filed: Sep. 25, 1996

[51] Int. Cl.[6] ..... F41A 17/00

[52] U.S. Cl. ..... 42/70.11

[58] Field of Search ..... 42/70.11

[56] References Cited

U.S. PATENT DOCUMENTS

| | | | |
|---|---|---|---|
| 3,462,869 | 8/1969 | Wallace | 42/70 |
| 3,553,877 | 1/1971 | Welch et al. | 42/70 |
| 4,038,771 | 8/1977 | Miller | 42/1 LP |
| 4,048,741 | 9/1977 | Chiodo et al. | 42/1 LP |
| 4,384,420 | 5/1983 | Von Muller | 42/1 LP |
| 4,499,681 | 2/1985 | Bako et al. | 42/1 Y |
| 4,528,765 | 7/1985 | Johnson | 42/1 LP |
| 4,532,729 | 8/1985 | Von Muller | 42/1 LP |
| 4,761,906 | 8/1988 | Guevara | 42/70.11 |
| 4,987,693 | 1/1991 | Brooks | 42/70.11 |
| 5,090,148 | 2/1992 | Brooks | 42/70.11 |
| 5,140,766 | 8/1992 | Brooks | 42/70.11 |
| 5,229,532 | 7/1993 | Brooks | 42/70.11 |
| 5,335,521 | 8/1994 | Brooks | 70/298 |

*Primary Examiner*—Charles T. Jordan
*Assistant Examiner*—Meena Chelliah
*Attorney, Agent, or Firm*—Quarles & Brady

[57] ABSTRACT

A firearm safety mechanism having a self-contained locking mechanism incorporated into the magazine of a semi-automatic pistol which inhibits use of the firearm when a locking mechanism is disabled thereby preventing cartridges from moving through the magazine as well as locking the magazine in position so as to prevent unauthorized replacement. In a second embodiment a firearm safety mechanism for a revolver equipped with a cylinder incorporates a locking mechanism which inhibits cartridge from aligning with the firing mechanism and prevents the unauthorized removal of the cylinder. The locks include a selection structure preventing movement of the engagement structure from a locked position to an unlocked position upon receipt of predetermined selection criteria. The firearm can be locked against unauthorized use and unlocked by an authorized user without resort to external accessories.

12 Claims, 7 Drawing Sheets

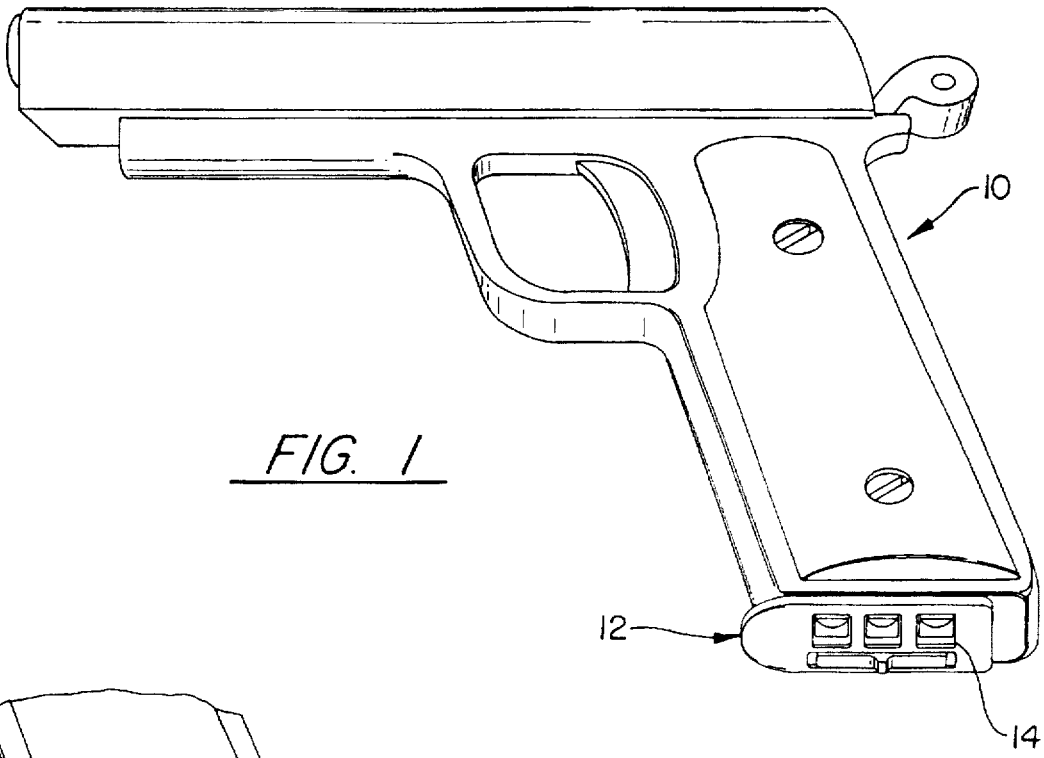
FIG. 1
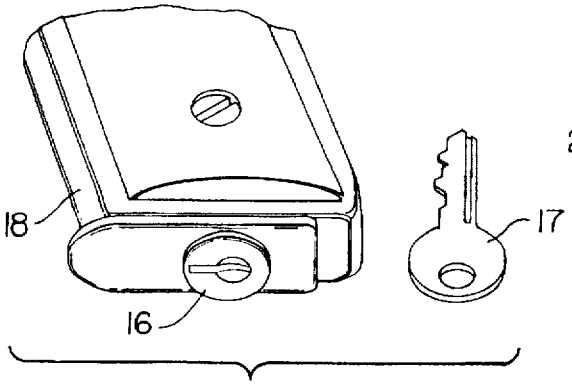
FIG. 2
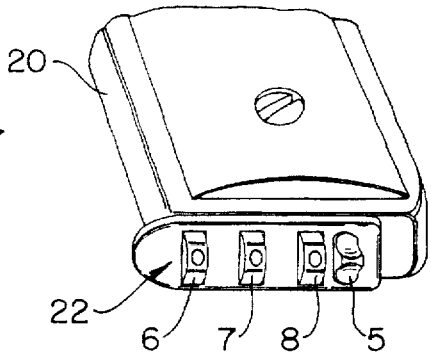
FIG. 3
FIG. 4
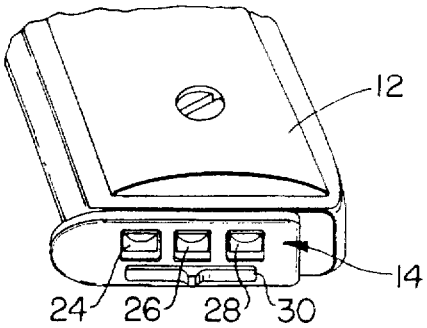

FIREARM SAFETY MECHANISM

FIELD OF THE INVENTION

A firearm safety mechanism for semi-automatic and automatic pistols and rifles equipped with a magazine or clip and revolvers equipped with a rotating cylinder.

DESCRIPTION OF THE PRIOR ART

There is a continuing concern about the prevalence of firearms in our society. Weather the firearm is a BB-gun, handgun, rifle, or military weapon, one of the objections to firearms relates to the use of these weapons by unauthorized persons. Tragic accidents occur when children happen upon firearms found often in their own homes, and attempt to play with them. The safety mechanisms found on firearms are not adequate to prevent injury, as curious children will often move the safety to an "off" position without their knowledge. A measure of safety can be obtained by removing the bullets from the firearm but it is time consuming to load a weapon in an emergency situation, and the danger exists that the gun will not be loaded fast enough to confront the emergency situation.

Another alarming situation is encountered when unauthorized persons wrestle such firearms from the hands of a gun wielder such as a police officer. In such an incident, the safety is only a slight impediment to firing of the firearm. At best, an engaged safety might give the police officer only an instant to try and retrieve the weapon. This situation might present itself to any individual who owns a handgun wherein the unauthorized person, such as the criminal element, is able to overpower the firearm owner and then use the firearm against the owner.

The applicant has previously disclosed locks adapted to be intricately included with firearms and which are able to prevent unauthorized use of the firearm. These locks contain portions which are adaptable to operatively engage a portion of the firing mechanism of the firearm to prevent operation of the firearm. This portion of the lock is moved out of operative engagement with the firing mechanism when the lock is in the "unlocked" position, to permit operation of the firearm. The inventor has been awarded U.S. Pat. No. 4,987,693 for a firearm safety mechanism; U.S. Pat. No. 5,090,148 for a firearm safety mechanism; U.S. Pat. No. 5,140,766 for a draw bar firearm lock; U.S. Pat. No. 5,229,532 for a grip lock assembly; and U.S. Pat. No. 5,335,521 for a grip lock assembly. Each of these disclosures sets forth embodiments on individual locking mechanisms which are incorporated herein by reference. The Applicant has previously disclosed constructions in which a locking bar moves into and out of an operative engagement with an existing external safety mechanism of the weapon to alternatively prevent or permit movement of the existing safety to the "unsafe" position. In another disclosure, a pin is moved into and out of an obstructing position with respect to the path of the hammer of the firearm to prevent or permit operation of the firearm.

There exists a continuing need to provide alternative lock configurations for the many firearms which are currently in existence. Particularly, there is a need to facilitate the installation of locks on existing firearms with provisions in which to lock the rotating cylinder of a revolver or the magazine or clip of a semi-automatic pistol or rifle.

SUMMARY OF THE INVENTION

It is an object of the invention to provide a firearm safety mechanism which will render the firearm inoperable to unauthorized users. It is another object of the invention to provide a firearm safety mechanism which can be quickly activated or de-activated by an authorized user. It is still another object of the invention to provide a firearm safety mechanism which is easily installed.

These and other objects are accomplished by a firearm safety mechanism in which a lock is installed in the magazine or clip of a semi-automatic or automatic pistol or rifle. Alternatively, a lockable cylinder is adapted to replace the existing cylinder in a revolver.

In one embodiment, a portion of the safety lock in the magazine or clip of a semi-automatic pistol can be moved into position to block the firing mechanism or existing safety on the firearm. Alternatively, a portion of the lock can be positioned wherein the bullets in the magazine cannot be loaded into the firing chamber, and/or the magazine cannot be released from its handle position. In this manner, a lock is located on the end of the magazine, thereby employing either a conventional key lock, a rotary combination lock, or a touch-sensitive combination lock. An advantage to this location for the lock is the ability to modify a firearm by simple replacement of a conventional magazine, with the magazine having a locking mechanism fully integrated therein. The safety or firing mechanism can be locked into a non-operative position. Alternatively, the magazine lock has a provision for either securing the bullets in the magazine and/or securing the magazine to the firearm which would conveniently prevent access to the bullets. In this manner, the magazine could not be removed from the gun without an authorization key or combination code.

In another embodiment, the cylinder of a revolver may include a key lock, a rotary combination lock, or a touch-sensitive combination lock so as to inhibit bullets from rotating into position in front of the hammer and barrel of the revolver. The lock would prevent rotation of the cylinder and optionally prohibit removal of the cylinder from the firearm. An advantage to this embodiment is that a revolver may be modified by simply replacement of the conventional cylinder with a cylinder having the locking mechanism.

In either embodiment, the firearm may be returned to its original state by replacement of the cylinder or magazine having the locking mechanism with the unmodified cylinder or magazine.

The type of lock that is used can be selected from a number of suitable designs. A preferable lock design is a combination lock in which one or more push members, such as buttons, are provided. Each of the buttons must be depressed an appropriate number of times, corresponding to the combination of the lock, in order to unlock the lock and to permit operation of the firearm. The Applicant has disclosed in the Applicant's prior art patents a variety of locks suitable for this purpose, although other locks would also be acceptable. It is also preferred that the lock be operable without the necessity of seeing the lock, allowing the lock to be disengaged in a dark environment. Thus, in the preferred embodiment, the lock comprises one or more push members, where each push member must be depressed a number of times, or in a proper sequence in order to open the lock.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 1 is a side view of semi-automatic pistol equipped with a magazine lock of the instant invention;

FIG. 2 is an end view of a magazine with a key lock;

FIG. 3 is an end view of a magazine with a rotary combination lock;

FIG. 4 is an end view of a magazine with a touch sensitive rotary combination lock;

DETAILED DESCRIPTION OF THE PREFERRED EMBODIMENT

Figure 5:
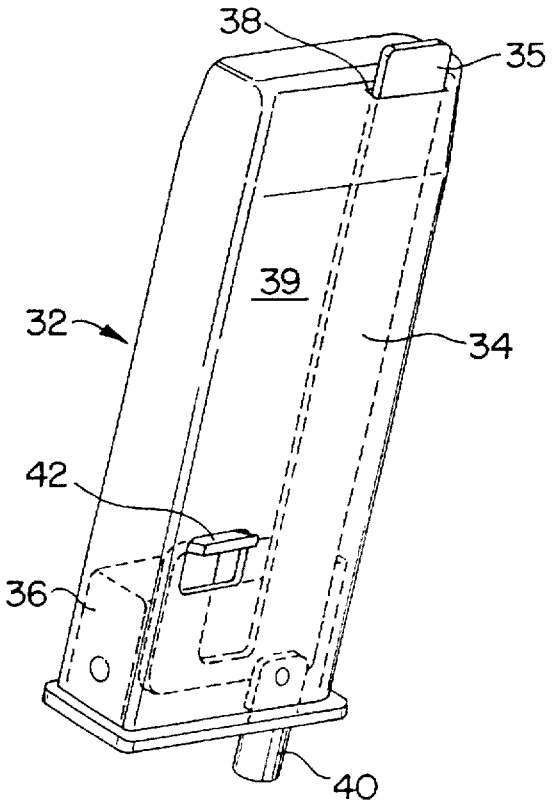
FIG. 5 is a pictorial view of a magazine with a locking device for preventing operation of a semi-automatic pistol firing mechanism.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

The safety mechanism of the invention can be used, with minor modification, in gun designs of many descriptions. The operation of most handguns is well understood, and described in several volumes including the Gun Digest Book of Firearms Assembly/Disassembly, Parts I and II; Automatic Pistols and Revolvers, by J. B. Wood, D. B. I. Books, Inc., Northbrook, Ill., 1979; The S&W Revolver, A Shop Manual, Jerry Kuhnhavsen, V.S.P. Publishers, Department 1A, Box 1966, Tusten, Calif. 92681; The Colt 45 Automatic, A Shop Manual, Jerry Kuhnhavsen, V.S.P. Publishers, Department 1A, Box 1966, Tusten, Calif. 92681; and the NA Guide to Firearms Assembly, National Rifle Association of America, 1600 Rhode Island Avenue N.W., Washington, D.C. 20036. The disclosures of the above-identified references are herein fully incorporated by reference. The invention can be utilized with automatic firearms such as the Baretta model 84BB, manufactured by the Fabbric d'ArmiPietro Beretta S.P.A. o Via Pietro Beretta, 18-25063 Gardone Val Trompia, Brescia, Italy. The weapon is fully described in the Owner's Manual Beretta dal 1526, Series 81, distributed by the company, which manual hereby is fully incorporated by reference. The invention can also be utilized with the Smith & Wesson semiautomatic centerfire pistols manufactured by the Smith & Wesson Company of 2100 Roosevelt Avenue, Springfield, Mass. The weapons are fully described in the Safety Instruction & Parts Manual, distributed by the company, which manual is hereby fully incorporated by reference.

Referring now to FIG. 1, a semi-automatic pistol 10 is shown with a magazine 12 which includes a push button locking mechanism 14 of the present invention. Referring also to FIG. 2, an alternative key lock mechanism 16 and key 17 are shown incorporated into the end of the extracted magazine 18. FIG. 3 shows yet another alternative extracted magazine 20 with a rotary locking mechanism 22 having a three rotary combination wheels 6, 7, and 8, and an activation lever 5. FIG. 4 shows the extracted magazine 12 of FIG. 1 with the push button, or touch sensitive, locking mechanism 14. In this instance, the mechanism 14 includes three push buttons 24, 26, and 28, and a slide bar activation lever 30.

Figure 6:
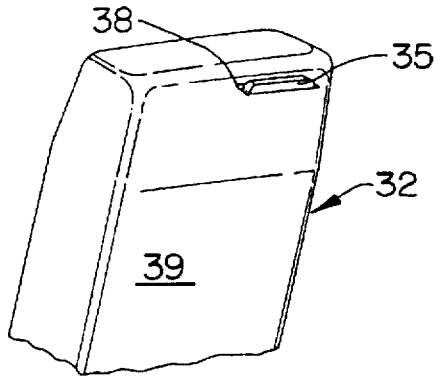
FIG. 6 is a top pictorial view of the magazine of FIG. 5.

Referring now to FIG. 5, a pictorial view of an embodiment of a magazine 32 is shown with a blocking arm 34 which is controlled by the inner locking module 36. The module 36 contains the operable parts of the locking mechanism, e.g. the tumblers and associated hardware which are operable moved when the lock buttons, rotary wheels, or key are used. In this example, the blocking arm 34 extends up through the magazine 32 with the top portion 35 protruding out of a hole 38 in the top of the magazine casing 39. The arm 34 is operably connected to the locking module 36 so that it can moved only when the locking mechanism is unlocked. A pushbutton or activation lever 40 extends from the bottom of magazine and allows advancement and retraction of the blocking arm 34 when the lock is unlocked. An interlocking bar 42 also extends from a cutout in the side of the magazine casing 39. This bar 42 serves to lock the magazine 32 in place so that it cannot be removed and thereby thwart the locking of the firearm. In FIG. 6, the top of the magazine casing 19 is shown with blocking arm portion 35 withdrawn or retracted into the magazine 32.

Figure 7:
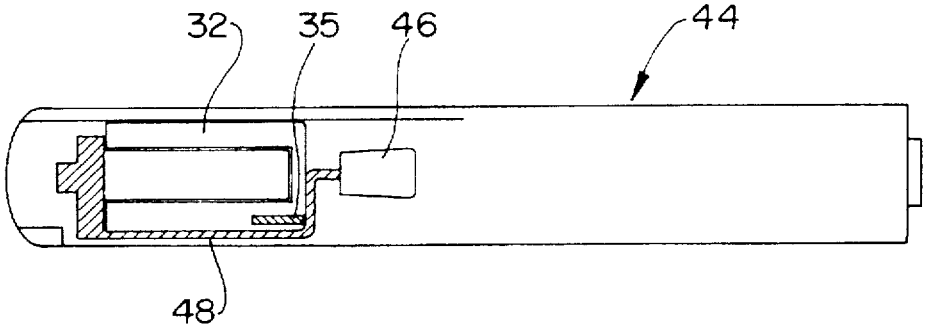
FIG. 7 is a top partial cut-away view of the pistol of FIG. 1 showing the safety mechanism being blocked by the magazine locking device.

Referring now to FIG. 7, a top view of a firearm 44 is shown with a partial cut-away view of the trigger 46 and associated safety mechanism 48 inside the gun. The magazine 32 is shown inserted into the gun 44 with the upper portion of the blocking arm 35 positioned to impede movement of the hammer or firing pin away from its locked position. Alternatively, the safety mechanism 48 can be extended forward with an extension 49 that butts against the trigger 46 of the gun 44. In this position, the safety 48 is "on" and the trigger 46 cannot be pulled to fire the gun. When the safety 48 is retracted, the safety is "off" and the trigger can be pulled. The blocking arm 35, when extended, is therefore positioned to prevent retraction of the safety 48.

Figure 8:
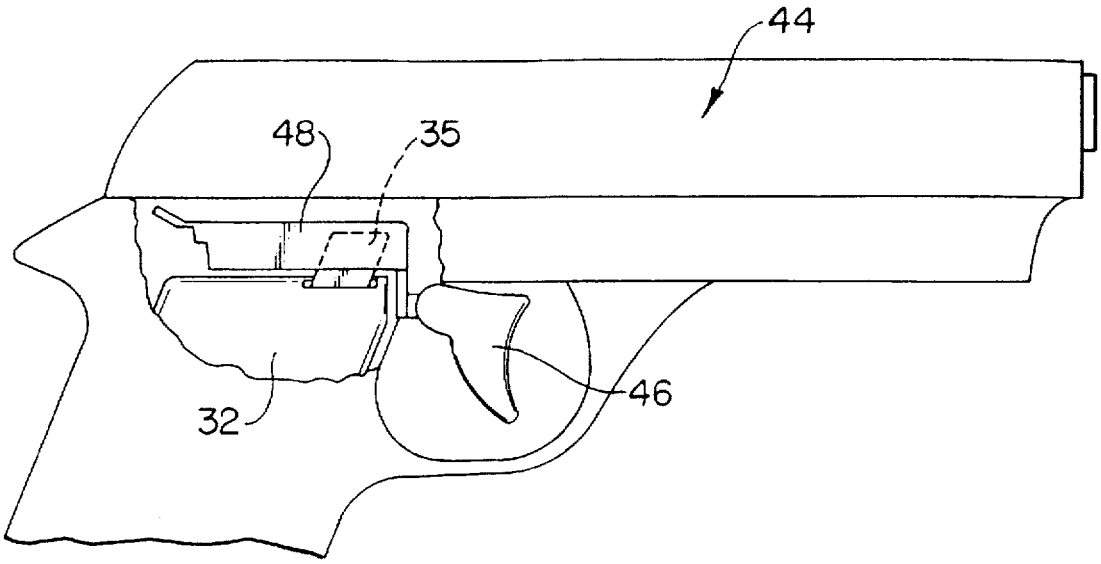
FIG. 8 is a side partial cut-away view of the pistol of FIG. 7 showing the safety mechanism being blocked by the magazine locking device.
Figure 9:
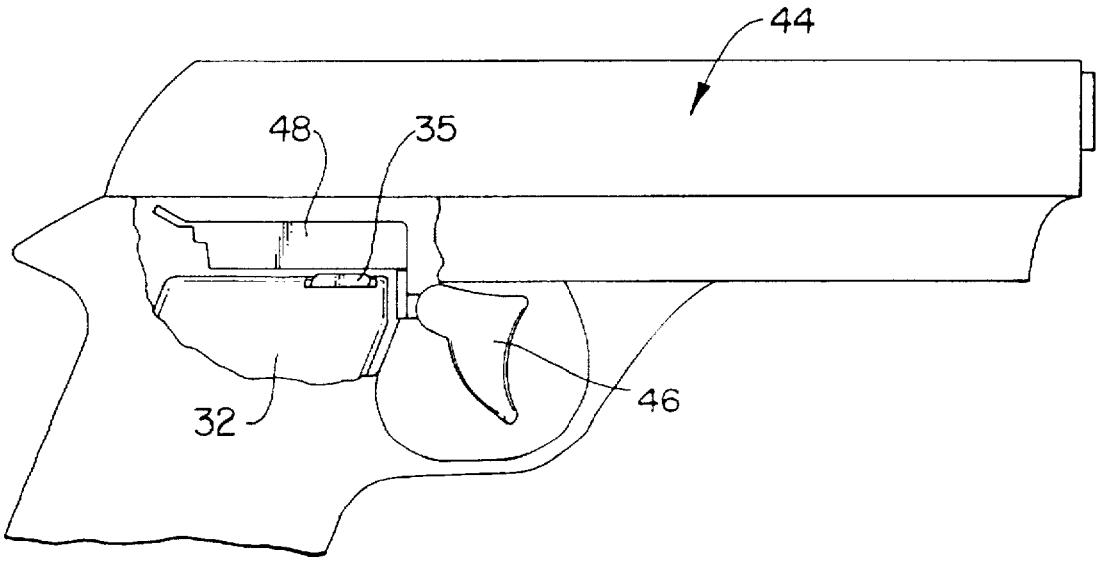
FIG. 9 is a side partial cut-away view of the pistol of FIG. 7 showing the safety mechanism unblocked by the withdrawn magazine locking device.

Referring now to FIG. 8, a side view of the firearm 44 is shown with a cut-away section of the trigger 46 and safety mechanism 48. The magazine 32 is shown inserted into position with the blocking arm portion 35 extended upwards to block the safety mechanism 48. Referring also to FIG. 9, a similar view is shown with the block arm portion 35 retracted. The safety mechanism 48 can therefore be slid backwards and the trigger can be freely pulled thereby firing the gun.

Figure 10:
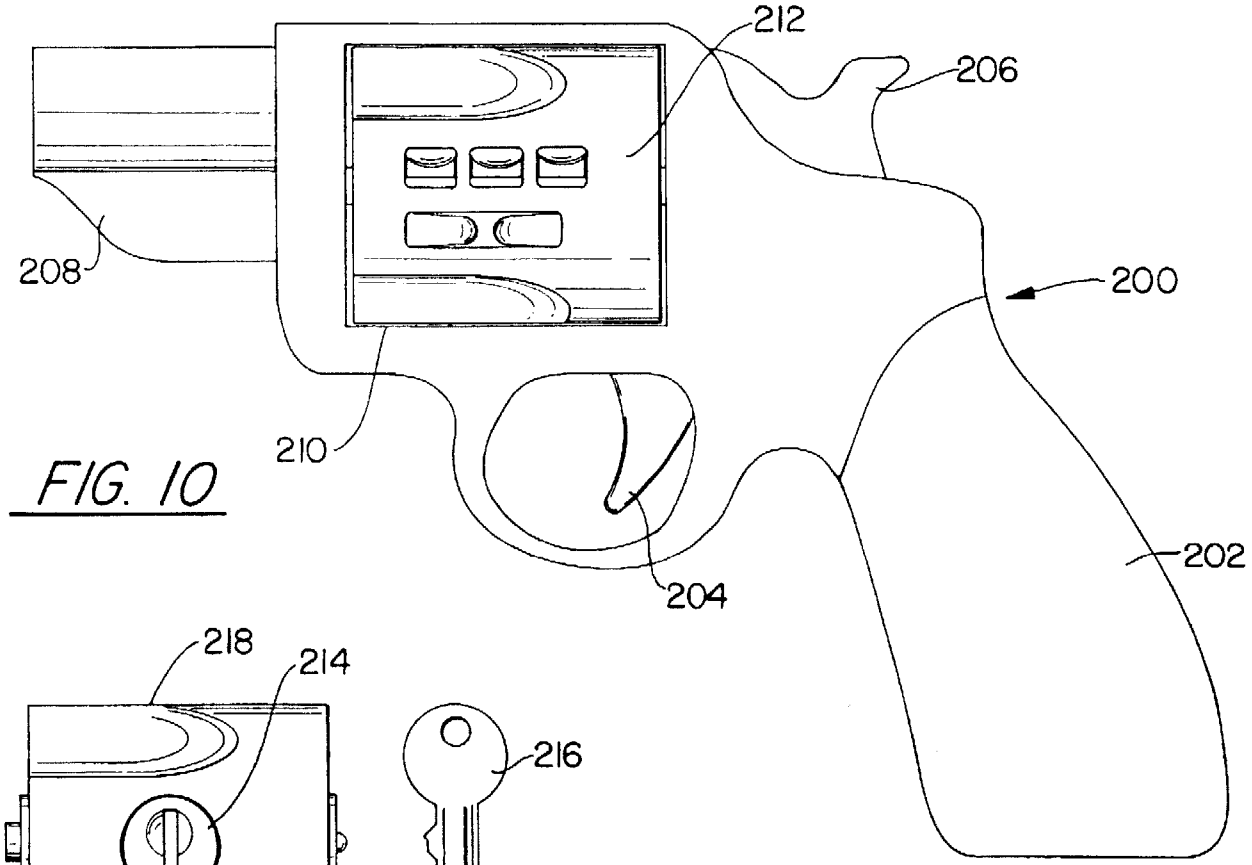
FIG. 10 is a side view of revolver equipped with a cylinder lock of the instant invention.
Figure 11:
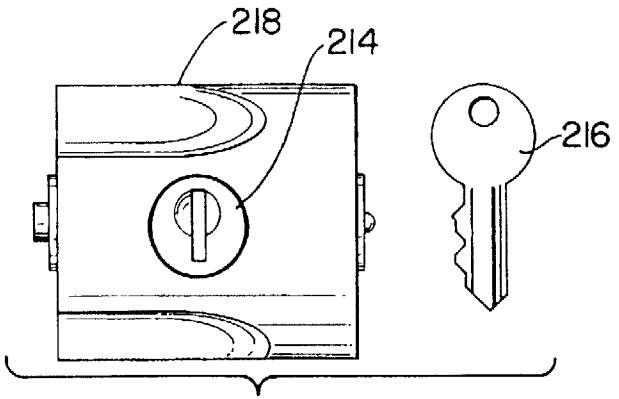
FIG. 11 is a side view of a cylinder with a key lock.
Figure 12:
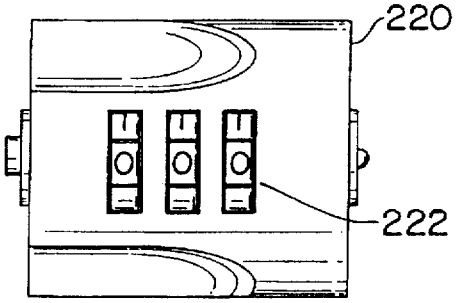
FIG. 12 is a side view of a cylinder with a rotary combination lock.
Figure 13:
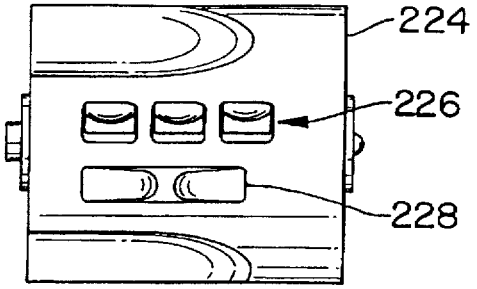
FIG. 13 is a side view of a cylinder with a touch sensitive rotary combination lock.

Referring now to FIG. 10, a revolver 200 is depicted having a handle 202, trigger 204 and hammer mechanism 206, barrel 208 and cylinder 210. The cylinder is the only part of the revolver that will have a modification allowing the cylinder to be replaced with a locking mechanism 212 of the present invention. Referring also to FIG. 11, an alternative key lock mechanism is depicted having key lock 214 and key 216 shown incorporated into the side wall of cylinder 218. FIG. 12 shows yet another alternative cylinder 220 with a rotary locking mechanism 222 having three rotary combination wheels. FIG. 13 shows the preferred embodiment incorporating a similar locking mechanism as the Applicant has disclosed in prior art patents previously listed. Cylinder 224 has a touch sensitive locking mechanism with depression buttons 226 and engagement bar 228.

Figure 14:
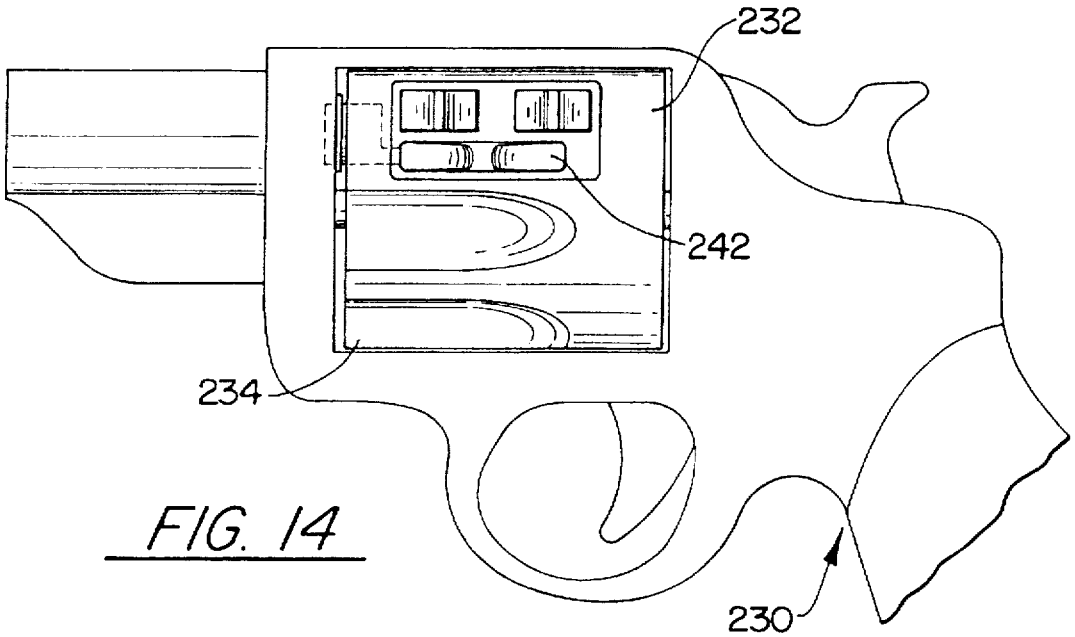
FIG. 14 is a side view of a revolver equipped with a cylinder lock in the locked position.
Figure 15:
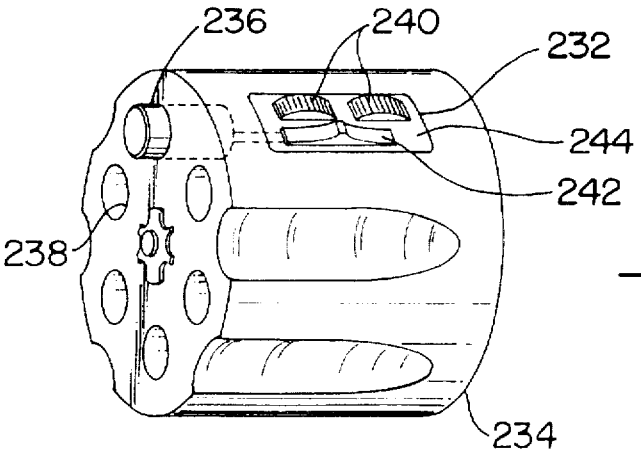
FIG. 15 is a pictorial view of the extracted cylinder of FIG. 14.

Referring now to FIGS. 14 and 15, a revolver 230 is depicted with a preferred locking mechanism 232 incorporated into detachable cylinder 234. A dead bolt 236 coupled to the locking mechanism 232 is depicted in an extended position, within one of the chambers 238 of cylinder 234, for partial insertion into the barrel of the revolver. The locking mechanism 232 having at least two combination buttons 240 and alternatively three, as depicted in FIG. 13, providing an authorized user with a means for moving the dead bolt 236 into the depicted extended position inhibiting movement of the cylinder. Slide bar 242 is coupled to the dead bolt 236 allowing engagement or disengagement as needed. The buttons 240 and slide bar 242 have a low clearance positioned within depression 244 commonly found on such cylinders for use as a gripping surface.

Figure 16:
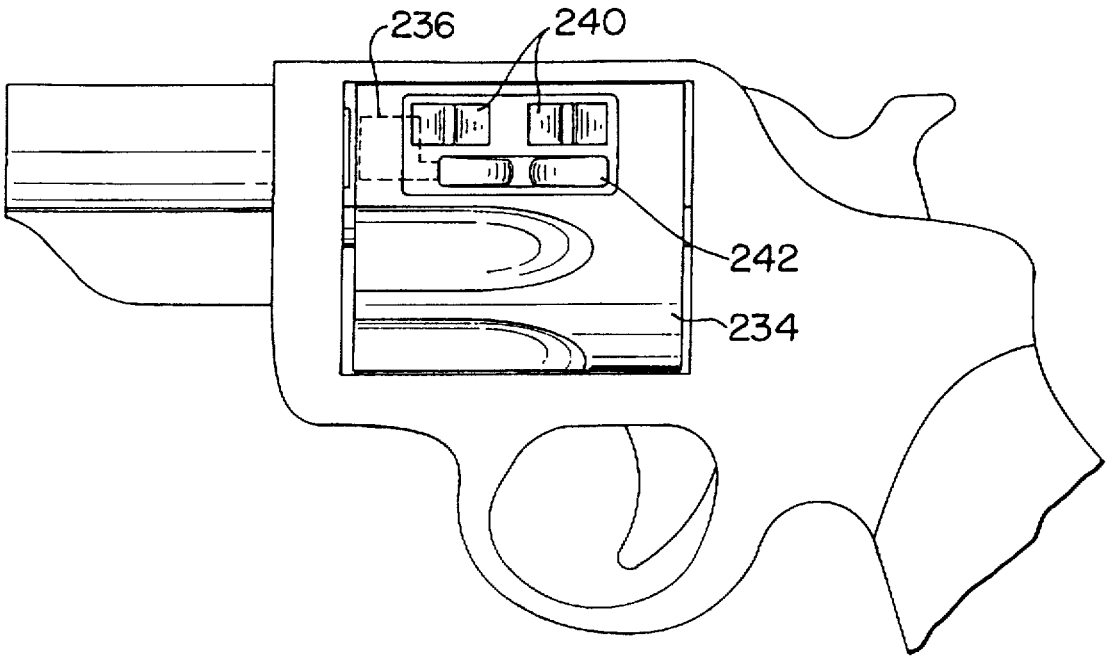
FIG. 16 is a side view of the revolver of FIG. 14 with the cylinder lock in the unlocked position.
Figure 17:
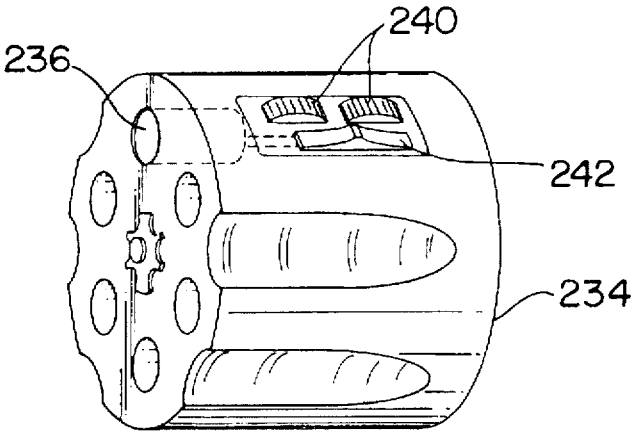
FIG. 17 is a side view of the extracted cylinder of FIG. 16.

As depicted in FIGS. 16 and 17, revolver 230 is depicted with a locking mechanism 232 incorporated into detachable cylinder 234 and dead bolt 236 positioned in a retracted position. In this manner, the locking mechanism is disengaged and an authorized user may utilize the firearm without restriction.

In an alternative embodiment, not shown, the locking mechanism can be placed external of the chamber with provision made to lock the cylinder in such a position so that the firing pin is not aligned with a chamber. In this embodiment a locking pin protrude from the cylinder to engage either edge of the revolver body and an impact pad may be positioned between the chambers of the cylinder to prevent damage to the firing pin if the chamber is off center and the firing pin forced to impact the cylinder.

Figure 18:
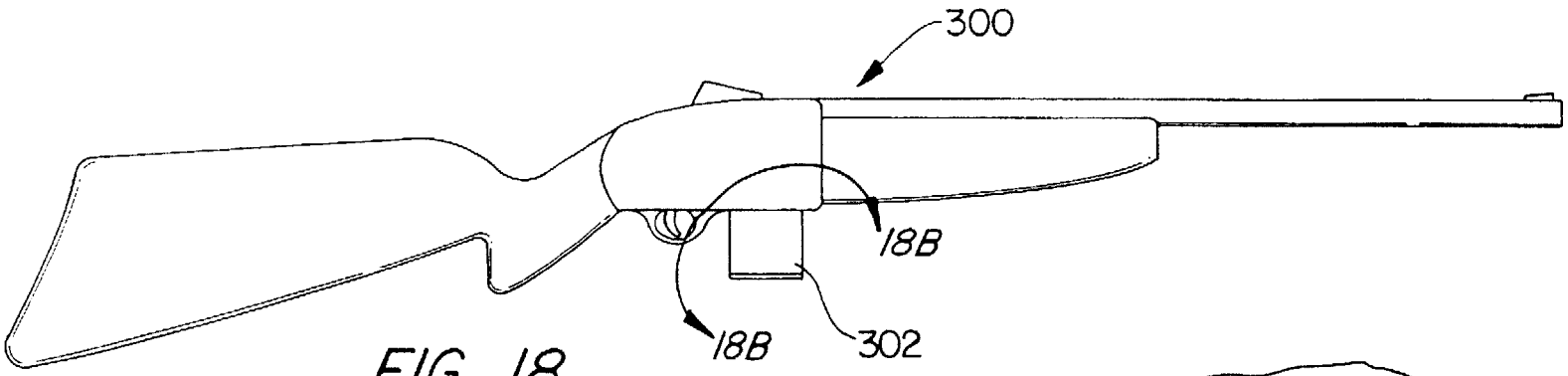
FIG. 18 is a side view of a rifle or longarm weapon with a locking magazine installed.
Figure 18B:
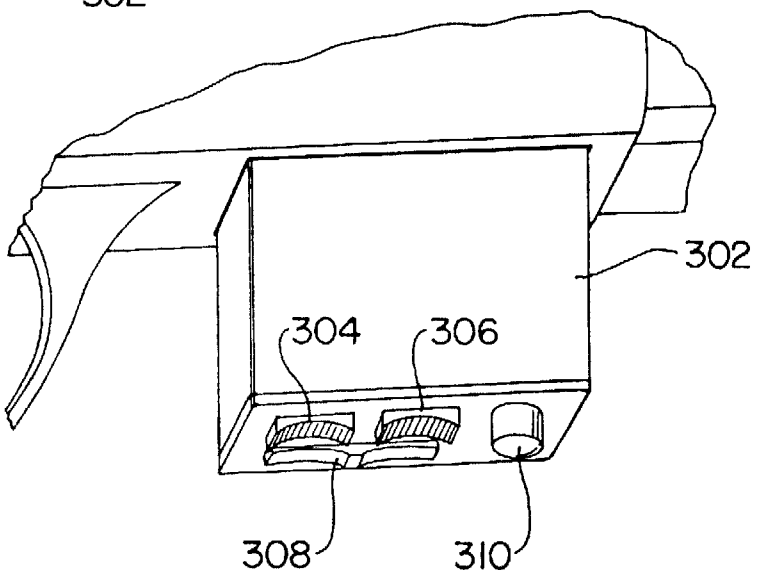
FIG. 18B is a close-up pictorial view of the mounted locking magazine of FIG. 18.
Figure 18A:
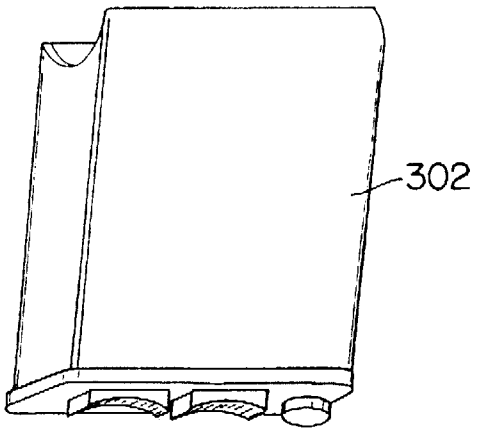
FIG. 18A is a side pictorial view of the extracted locking magazine of FIG. 18.

Referring now to FIG. 18, a rifle 300 is shown with a locking magazine 302 of the present invention installed. Referring also to FIG. 18A, the magazine 302 is shown extracted from the rifle. FIG. 18B shows a close view of the magazine 302 installed in the rifle 300. In this embodiment, the magazine includes a first and second pushbutton 304, 306 with an activation lever 308 and a pushbutton activator 310.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim is:

1. In a firearm having a firing chamber for receiving ammunition from a detachable magazine, said detachable magazine comprising structure for containing ammunition, structure for preventing firing of said firearm, and a first locking means for controlling said structure for preventing firing of said firearm; wherein said structure for preventing firing of said firearm and said first locking means are formed integral to said magazine.

2. The firearm according to claim 1 including a second locking means for coupling said magazine to said firearm.

3. The firearm according to claim 1 including a visual indicator means responsive to said blocking arm means or said first locking means providing a visual indication of firearm operational status.

4. In a firearm having a firing chamber for receiving ammunition from a detachable magazine, said detachable magazine comprising structure for containing ammunition; an actuating member operatively associated with said magazine, and having a distal end and a proximal end; and a locking mechanism for controlling said actuating member, said locking mechanism operatively associated with said proximal end; wherein said actuating member and said locking mechanism are formed integral to said magazine.

5. The firearm according to claim 4 wherein said locking mechanism includes at least one push member being operable to unlock said lock mechanism upon depression of the push member in accord with a predetermined combination.

6. The locking device according to claim 4 wherein said distal end is extendable in front of an insertion end to prohibit ammunition from entering said firing chamber.

7. The locking device according to claim 4 wherein said distal end engages a safety.

8. In a firearm revolver having a revolving detachable cylinder for holding and firing ammunition, a locking device comprising: a guard means for prohibiting rotation of said cylinder in said firearm and thereby preventing ammunition from rotating into place for firing; a first locking means for controlling said guard means; wherein said first guard means and said first locking means are formed integral to said cylinder.

9. The locking device according to claim 8 including a second locking means for lockably coupling said cylinder to said firearm.

10. The locking device according to claim 8 including a visual indicator means responsive to said guard means or said first locking means providing a visual indication of firearm operational status.

11. In a firearm revolver having a barrel and a revolving detachable cylinder with receptacles for holding and firing ammunition, a locking device comprising:

an actuating member operatively associated with one of said receptacles in said cylinder, said actuating member having a distal end extending into said barrel; a locking mechanism operatively associated with said proximal end of said actuating member; wherein said actuating member and said locking mechanism are formed integral to said cylinder.

12. The locking device according to claim 11 wherein said locking mechanism includes at least one push member being operable to unlock said lock mechanism upon depression of the push member in accord with a predetermined combination.

* * * * *